US011525282B2

(12) United States Patent
Chen

(10) Patent No.: US 11,525,282 B2
(45) Date of Patent: Dec. 13, 2022

(54) ELECTRONIC SEAL WITH QUALITY CONTROL IMPLEMENTABLE WITH MOBILE PHONE

(71) Applicant: Chih-Chuan Chen, Nantou (CN)

(72) Inventor: Chih-Chuan Chen, Nantou (CN)

( * ) Notice: Subject to any disclaimer, the term of this patent is extended or adjusted under 35 U.S.C. 154(b) by 862 days.

(21) Appl. No.: 16/431,722

(22) Filed: Jun. 4, 2019

(65) Prior Publication Data

US 2020/0386009 A1 Dec. 10, 2020

(51) Int. Cl.

| | |
|---|---|
| ***G09F 3/03*** | (2006.01) |
| ***E05B 39/00*** | (2006.01) |
| ***H01Q 1/44*** | (2006.01) |
| ***H01Q 1/38*** | (2006.01) |
| *E05B 47/00* | (2006.01) |
| *H01Q 1/22* | (2006.01) |

(52) U.S. Cl.

CPC ..... *E05B 39/00* (2013.01); *G09F 3/0317* (2013.01); *G09F 3/0376* (2013.01); *H01Q 1/38* (2013.01); *H01Q 1/44* (2013.01); *E05B 2047/0095* (2013.01); *H01Q 1/2208* (2013.01)

(58) Field of Classification Search

CPC . G09F 3/00; G09F 3/03; G09F 3/0305; G09F 3/0317; G09F 3/0329; G09F 3/0335; G09F 3/0347; G09F 3/0358; G09F 3/0376; Y10T 292/331; Y10T 292/336; Y10T 292/48; Y10T 292/4925; Y10T 292/50; Y10T 292/503; Y10T 292/507; Y10T 292/509; Y10T 292/51; Y10T 292/528; Y10T 292/534

See application file for complete search history.

(56) References Cited

U.S. PATENT DOCUMENTS

| | | | | |
|---|---|---|---|---|
| 8,319,647 | B2 * | 11/2012 | Chen | G09F 3/0376 29/282 |
| 8,508,371 | B2 * | 8/2013 | Lee | H01Q 1/2208 340/10.1 |
| 8,558,700 | B2 * | 10/2013 | Chen | G09F 3/0335 29/282 |
| 8,742,931 | B2 * | 6/2014 | Lee | G06K 19/07798 340/572.1 |
| 8,866,609 | B2 * | 10/2014 | Chen | G09F 3/0335 340/572.9 |
| 9,508,271 | B2 * | 11/2016 | Chen | G09F 3/0317 |
| 10,510,272 | B1 * | 12/2019 | Chen | G09F 3/0335 |
| 10,580,275 | B2 * | 3/2020 | Chen | G09F 3/0335 |
| 10,916,161 | B1 * | 2/2021 | Chen | G09F 3/0329 |

* cited by examiner

*Primary Examiner* — Alyson M Merlino
(74) *Attorney, Agent, or Firm* — Leong C. Lei

(57) ABSTRACT

An insertion pin includes a pin member on which a circuit board, an inspection antenna, and an inspection chip are mounted. The circuit board includes a main circuit, a main chip, and an inspection circuit set in an open-circuit condition with respect to the inspection antenna and the inspection chip. A lock base includes a main antenna matching the main chip. When the lock base and the pin member are combined and locked together, the main chip is electrically connected with the main antenna to emit a first signal for monitoring with an identification device, and the inspection circuit is electrically connectable with the inspection chip and the inspection antenna to emit a second signal to allow a mobile phone to carry out quality control to determine if the first signal is in normal operation. Cutting off the insertion pin terminates both the first and second signals.

20 Claims, 10 Drawing Sheets

ELECTRONIC SEAL WITH QUALITY CONTROL IMPLEMENTABLE WITH MOBILE PHONE

TECHNICAL FIELD OF THE INVENTION

The present invention relates to a technique that allows an end user to carry out actual inspection on an electronic seal with a mobile phone to determine if the electronic seal is operable normally.

DESCRIPTION OF THE PRIOR ART

Patent documents in the field of electronic seal are known, such as U.S. Pat. Nos. 8,558,700B2, 8,866,609B2, and 9,508,271B2, which are owned by the present inventor. However, it is noted that in such prior art patent documents, a spring is integrally formed with a lock base. In order to provide a structural strength of the spring, a clearance of the spring is controlled in a range of 1-2 mm. However, there is always a tolerance exhibiting in mounting a circuit board on an insertion pin and there is also a tolerance in mounting and locking the insertion pin in the lock base.

Accumulation of such tolerances would inevitably lead to a flaw concerning the clearance for movement of the spring. Thus, although the insertion pin and the lock base, when manufactured separately, are both acceptable in quality control inspection, when an end user attempts to have the insertion pin and the lock base combined for locking together as a seal of a cargo container, there might be situation of signal losing or poor signal reading, so as to cause a loss of monitoring function, while the end user may not properly aware of such a situation.

SUMMARY OF THE INVENTION

The primary objective of the present invention is to provide an arrangement in which a circuit board is provided to receive a main circuit, a main chip, and an inspection circuit to be mounted thereon and an insertion pin is provided, at suitable locations thereof, with an inspection antenna and an inspection chip that match the inspection circuit. Further, it is provided that in a condition that the insertion pin is combined with and locked to a lock base, the main circuit and the main chip are electrically connected with a main antenna existing in the lock base to emit a first signal for monitoring and the inspection circuit, the inspection chip, and the inspection antenna are set so as to electrically connect to emit a second signal, wherein the second signal is provided for quality control implemented with software of a mobile phone to determine if the first signal is in normal operation so as to prevent use of a flaw product.

DETAILED DESCRIPTION OF THE PREFERRED EMBODIMENT

Figure 6:
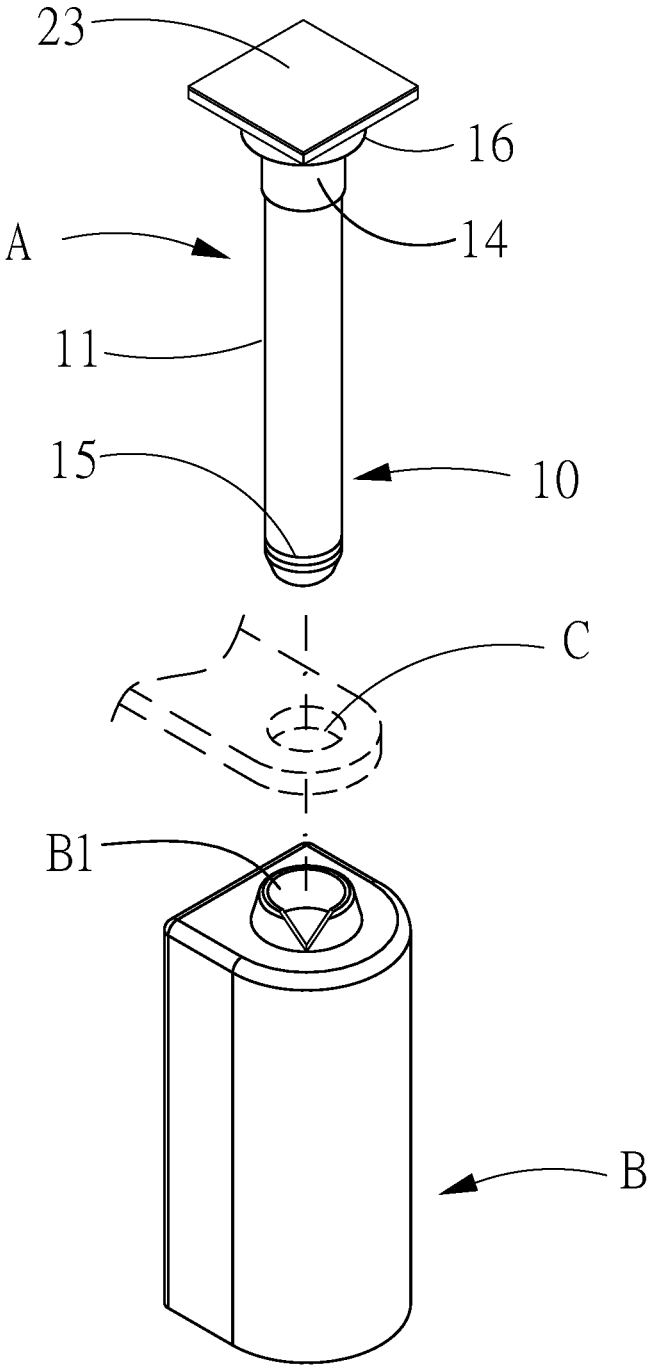
FIGS. 6 and 7 are a perspective view and a cross-sectional view, respectively, showing an insertion pin according to the present invention, a cargo container door latch, and a lock base in a detached condition.
Figure 7:
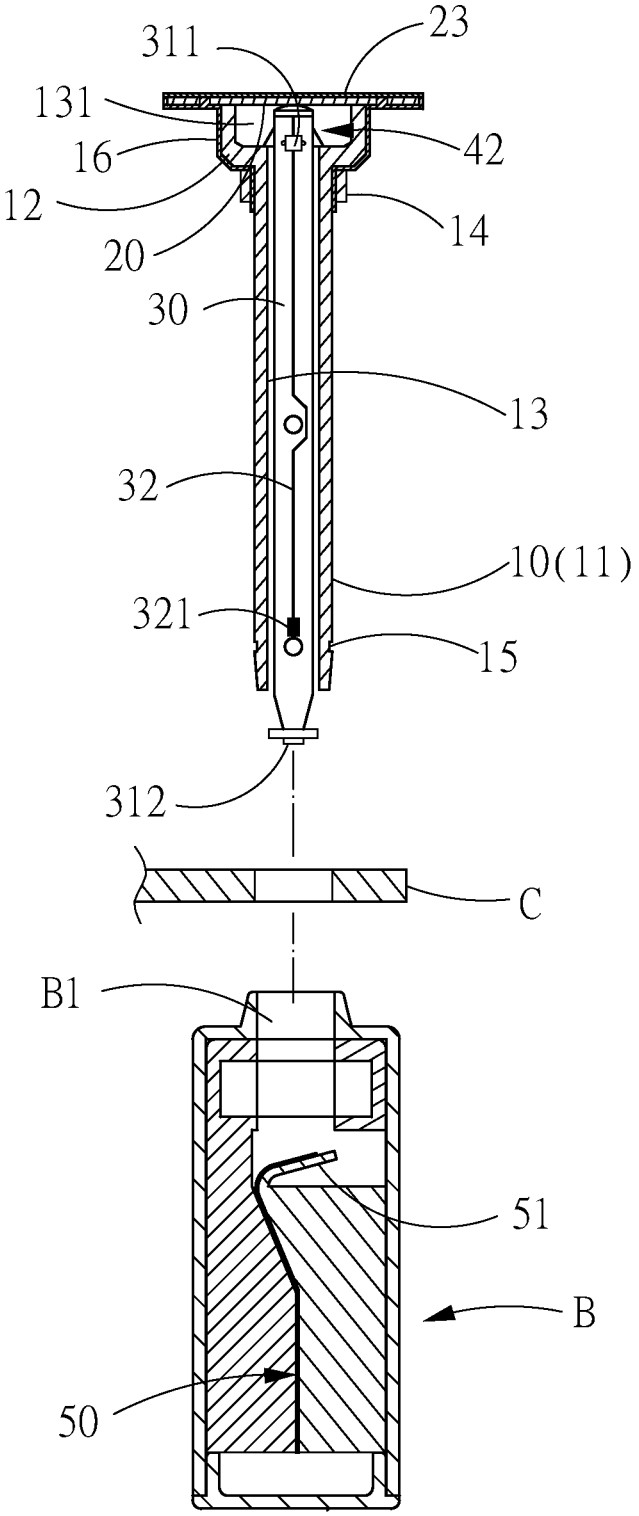
Figure 8:
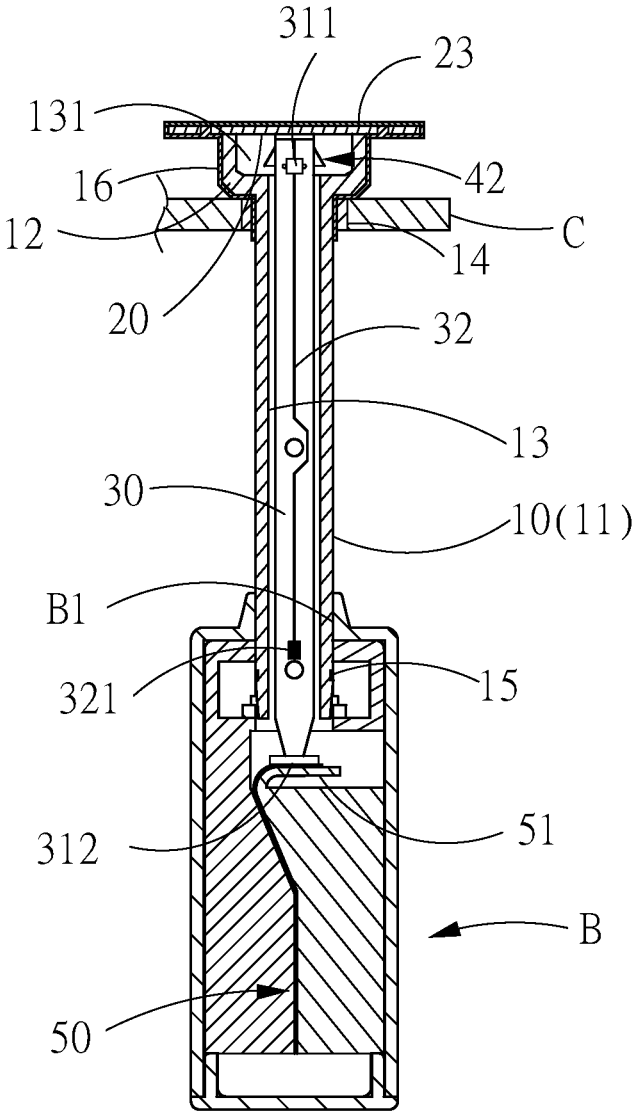
FIG. 8 is a cross-sectional view showing, in an assembled condition, the insertion pin according to the present invention and the lock base in a locked condition.

As shown in FIGS. 6-8, the present invention provides an electronic seal, which is made up of an insertion pin A and a lock base B. The insertion pin A can be inserted, in a direction from top to bottom, to be locked in the lock base B in order to secure a cargo container door latch C, so that a custom agency inspection device may inspect if a cargo container is normally opened.

Referring to FIGS. 1-10, the insertion pin A comprises a pin member 10 on which an inspection antenna 21, an inspection chip 22, a circuit board 30, and a preloading structure 40 are mounted.

The pin member 10 is made of a material that conducts an electrical current to flow therethrough and comprises a pin body 11, a head cap 12 formed by radially expanding a top end portion of the pin body 11, an accommodation hole 13 formed through a top surface and a bottom surface thereof, and a fitting ring 14 abutting against a bottom of the head cap 12. The accommodation hole 13 has a top end section that is radially expanded to define a counterbore 131. The pin member 10 is formed with an engagement arrangement 15 by circumferentially recessing an outer circumference of a lower portion thereof. Further, the head cap 12 is covered, on an outer circumference and an underside thereof, with a plastic cover 16. The plastic cover 16 is partly extended upward to form multiple positioning pins 161 projecting beyond a top surface of the pin member 10.

Figure 5:
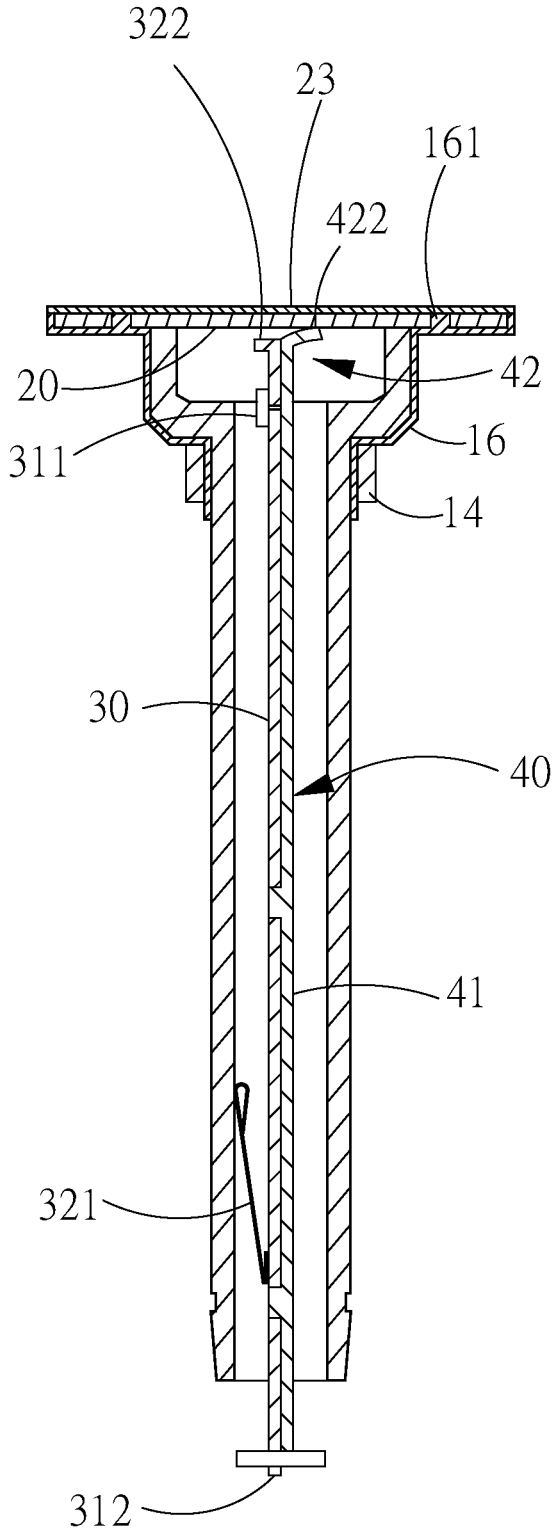
FIG. 5 is a cross-sectional view showing the insertion pin according to the present invention in an assembled form.

Referring to FIGS. 1-5, the inspection antenna 21 and the inspection chip 22 are arranged on an insulation substrate 20. The substrate 20 is formed with positioning holes 201 that are provided to correspond to and engage with the positioning pins 161 so as to have the substrate 20 accurately close and cover the counterbore 131. The inspection antenna 21 is made in a helical form provided on a top of the substrate 20 and comprises an internal starting terminal 211 and an external ending terminal 212 and is provided with a separate terminal 213 that is spaced from the internal starting terminal 211 by a predetermined distance. Further, the substrate 20 is provided, on a bottom thereof, with a planar terminal 214 connected to the separate terminal 213. Further, the substrate 20 is provided, on the bottom thereof, with an annular terminal 215, which is formed around a center defined by the planar terminal 214, and connected with the external ending terminal 212. The planar terminal 214 is arranged at a central location of a range of the counterbore 131. The annular terminal 215 is arranged to correspond to and abut against an annular top surface of the pin member 10. The inspection chip 22 is mounted between the internal starting terminal 211 and the separate terminal 213 so that the inspection antenna 21, the inspection chip 22, and the pin member 10 jointly form a conductive path. The substrate 20 is formed with a through aperture through which the separate terminal 213 and the planar terminal 214 are connected, wherein the through aperture is provided, on an internal surface thereof, with a conductive film so as to electrically connect the separate terminal 213 and the planar terminal 214 to each other. A similar structural arrangement may be employed between the external ending terminal 212 and the annular terminal 215. Further, the substrate 20 may be provided, around an outer periphery thereof, with an enclosure film 23 attached thereto as shown in FIG. 5, such that the enclosure film 23 and the plastic cover 16 are combined as a unitary structure to strengthen a structural arrangement of the substrate 20 and the pin member 10 and to provide waterproofness for the inspection antenna 21 and the inspection chip 22. The substrate 20 may be sized to have a surface area that is larger than the head cap 12, so as to increase a range of reading or detection of the inspection antenna 21, allowing a mobile phone, which will be discussed hereinafter, to easily receive a second signal.

Referring to FIGS. 1, 2, 3, and 5, the circuit board 30 is suspended in the accommodation hole 13 by having a back side thereof supported by a preloading structure 40. The circuit board 30 comprises a main circuit 31 and is provided, on a front side thereof, with an inspection circuit 32. The main circuit 31 and the inspection circuit 32 is electrically isolated from each other. The main circuit 31 at least comprises a main chip 311 and a bottom contact 312 arranged at a bottom of the circuit board 30. The inspection circuit 32 comprises an elastic contact leg 321 in abutting engagement with an inside surface of the accommodation hole 13 and a top contact 322 arranged at a top of the circuit board 30. The top contact 322 is set at a location below the planar terminal 214. In the embodiment of the present invention illustrated in the drawings, the main chip 311 may adopt a RFID frequency band or a microwave frequency band, and the inspection chip 22 may adopt a magnetic field frequency band for quality control conducted with software of a mobile phone. The magnetic field frequency band can be an NFC system or an LF system. Alternatively, the main chip 311 can be similarly used with a magnetic field and under such a condition, the inspection chip 22 is alternatively used with a RFID frequency band or a microwave frequency band.

The preloading structure 40 comprises a coupling section 41 fixed to the back side of the circuit board 30 and is also provided with a barbed engagement section 42 arranged at a top of the coupling section 41. The barbed engagement section 42 comprises a first elastic tab 421 extending downward to abut against a bottom surface of the counterbore 131 and a second elastic tab 422 extending upward to elastically abut against the bottom of the substrate 20 so as to elastically suspend the circuit board 30 in the accommodation hole 13 and to keep a gap between the top contact 322 and the planar terminal 214 for maintaining the inspection antenna 21 and the inspection chip 22 in an open-circuit condition and allowing the bottom contact 312 to readily project out of a bottom end of the accommodation hole 13.

Figure 1:
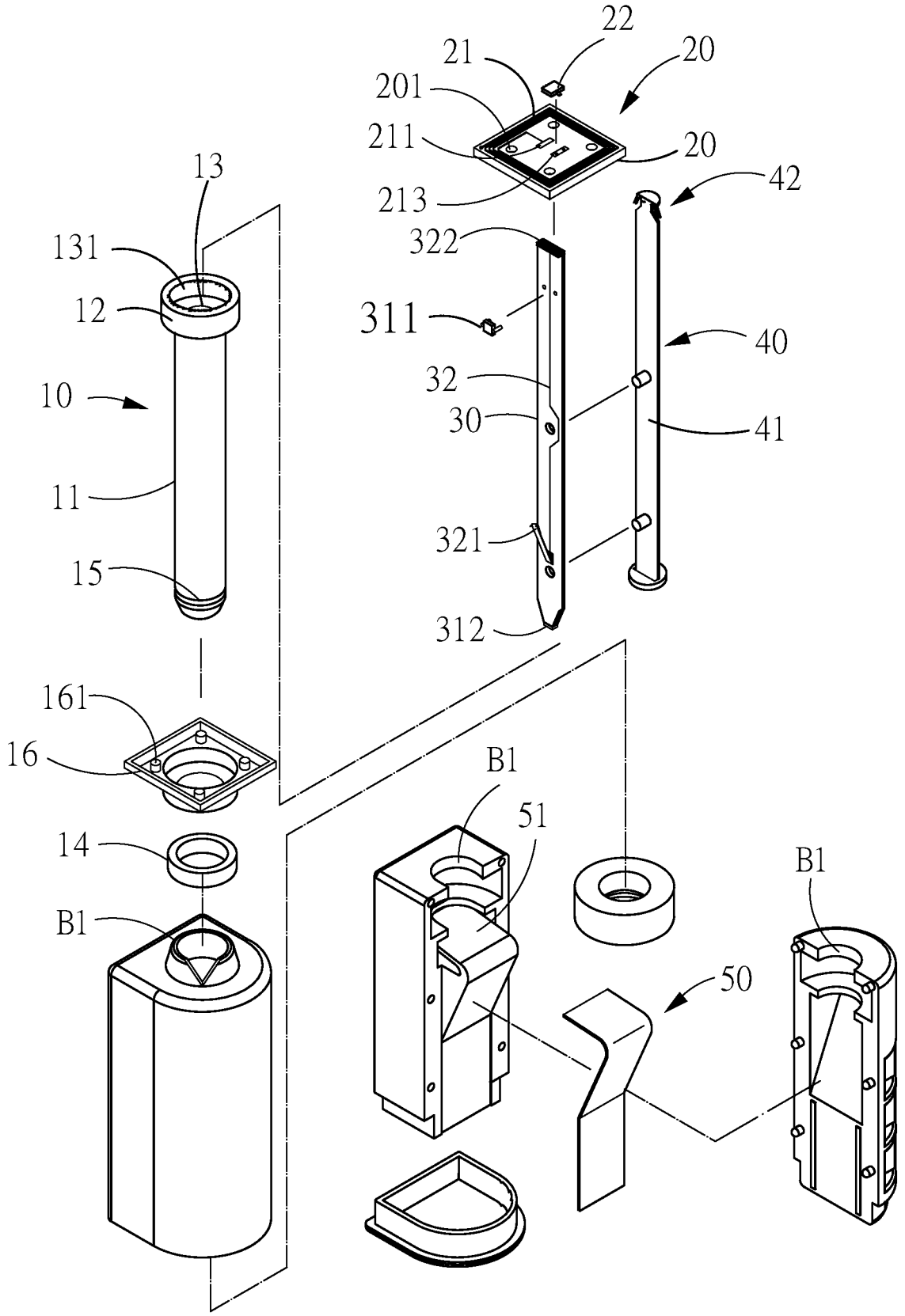
FIG. 1 is an exploded view showing the present invention.
Figure 9:
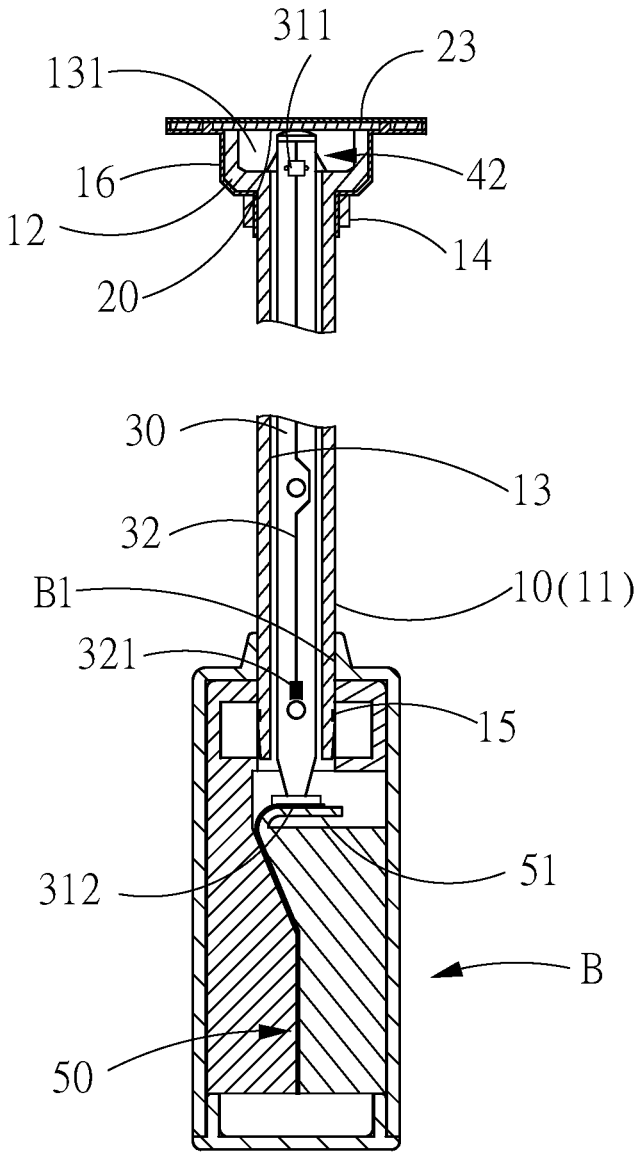
FIG. 9 is a cross-sectional view showing a condition in which the insertion pin according to the present invention is cut off.
Figure 10:
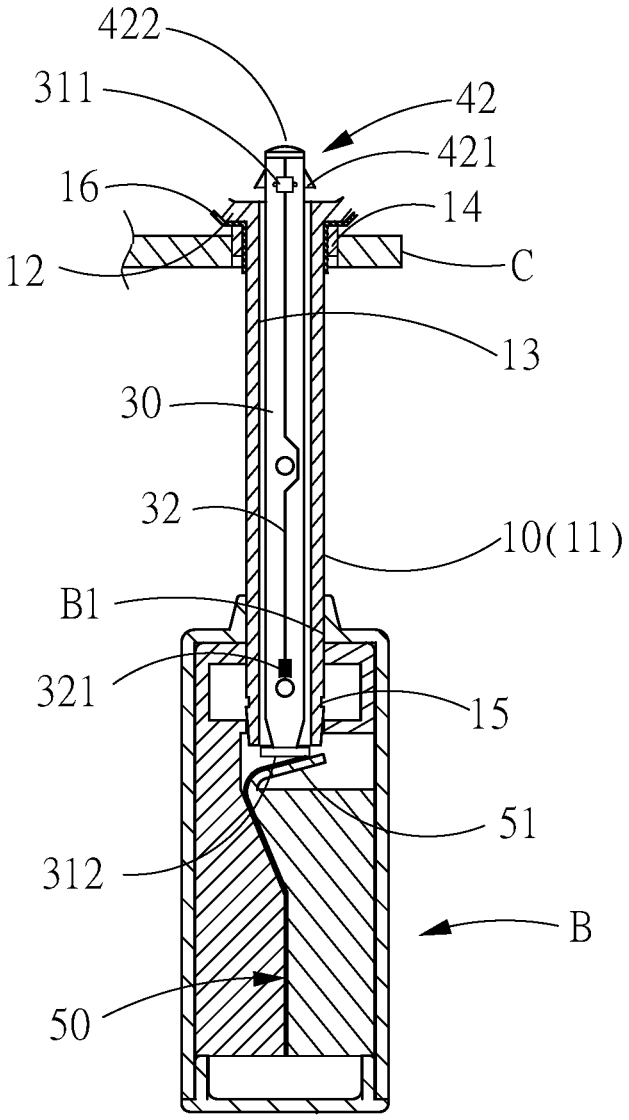
FIG. 10 is a cross-sectional view showing a condition in which the inspection antenna of the present invention is damaged.

Referring to FIGS. 1, 7, and 8, the lock base B is structured as those disclosed in the above-mentioned prior art patent documents and will not be discussed in detail herein. The lock base B is provided, in an interior thereof, with a main antenna 50 matching the main chip 311 and an elastic unit 51 that acts on the main antenna 50. The lock base B is further formed with a locking hole B1 that may receive insertion of a lower portion of the pin member 10, such that during the insertion, upon electric connection of the bottom contact 312 with the main antenna 50, the main chip 311 and the main antenna 50 issue a first signal in the RFID frequency band or the microwave frequency band to allow a custom agency to carry out management of identification. Subsequently, once the engagement arrangement 15 is positioned and locked in the locking hole B1, the pin member 10 is prohibited from detaching from the locking hole B1 and the preloading provided by the barbed engagement section 42 is overcome so that the top contact 322 is allowed to contact and in conducting engagement with the planar terminal 214 to control the inspection antenna 21, the inspection chip 22, the pin member 10, and the inspection circuit 32 to form electric connection to emit a second signal in the magnetic field frequency band, wherein the second signal allows quality control conducted with mobile phone software to determine is the first signal in operation normally so that an end user is enabled to terminate use of a flaw product to ensure effective monitoring of closure of a cargo container. It is noted here that the first signal and the second signal are respectively set up in different frequency bands. As shown in FIG. 9, when both the second signal and the first signal are in normal operation, cutting off the pin member 10 would cut off the main circuit 31 and the inspection circuit 32 of the circuit board 30 so as to terminate the first and second signals for application to a condition of normally opening the cargo container. FIG. 10 illustrates a condition where the substrate 20 is damaged without authorization, and in such a condition, the first and second signals may also be terminated and the custom agency may identify the unauthorized opening of the cargo container.

It is note that the first signal and the second signal may carry or be built therein with identical serial number (identification number), so that the mobile phone and the custom agency may identify if the cargo container and the serial number match with each other.

Figure 2:
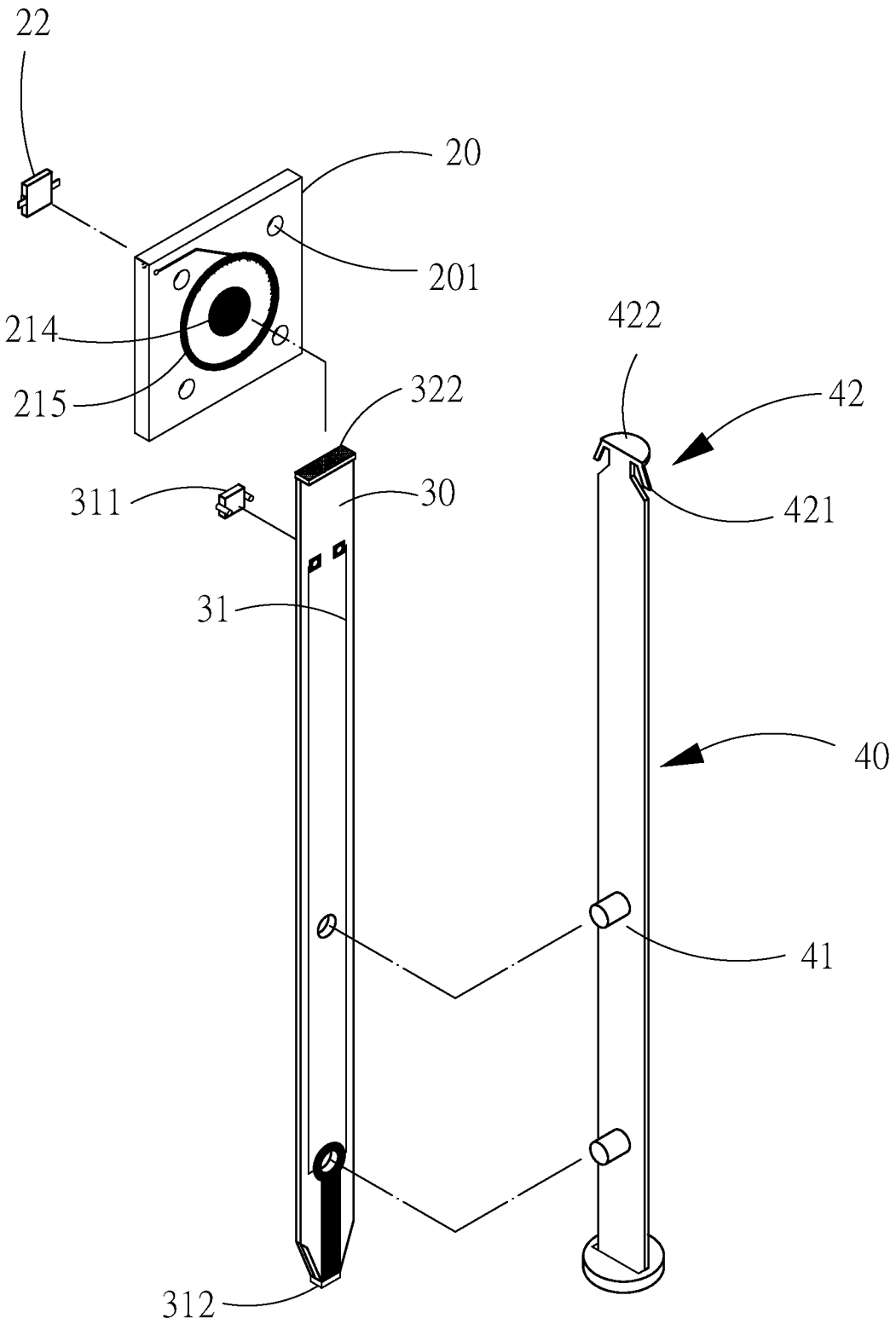
FIG. 2 illustrates a relative position between a circuit board and an inspection antenna and an inspection chip according to the present invention.
Figure 3:
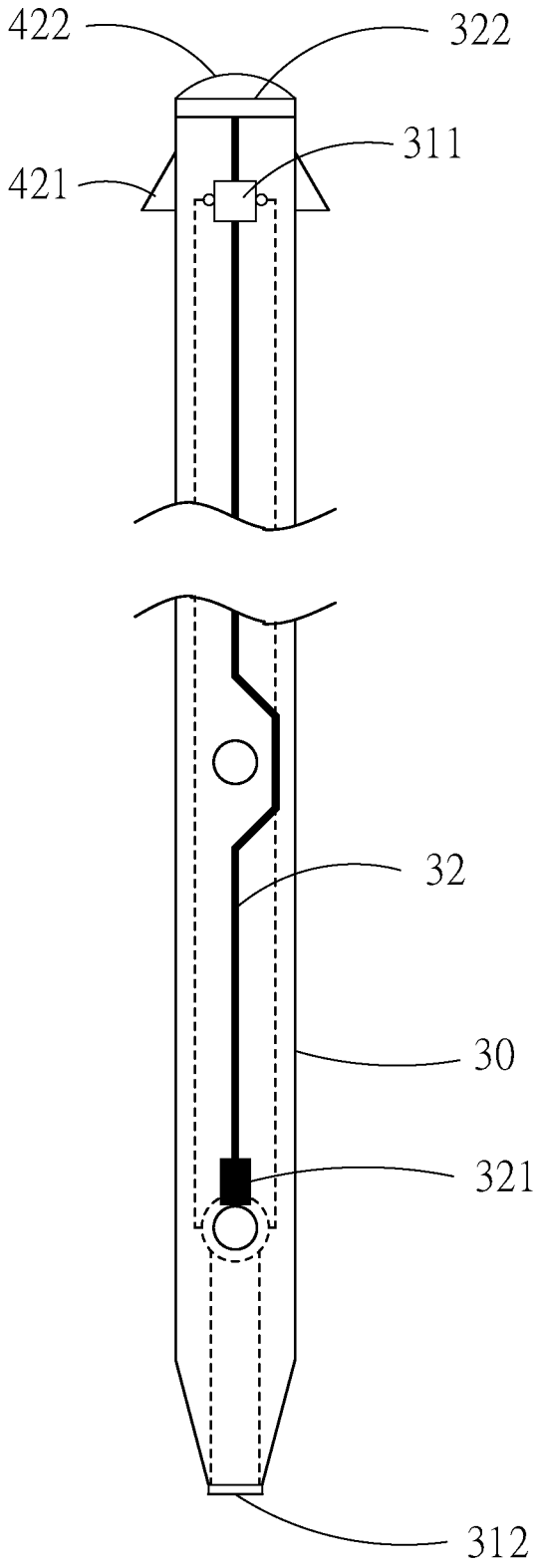
FIG. 3 is a front view of the circuit board of the present invention.
Figure 4:
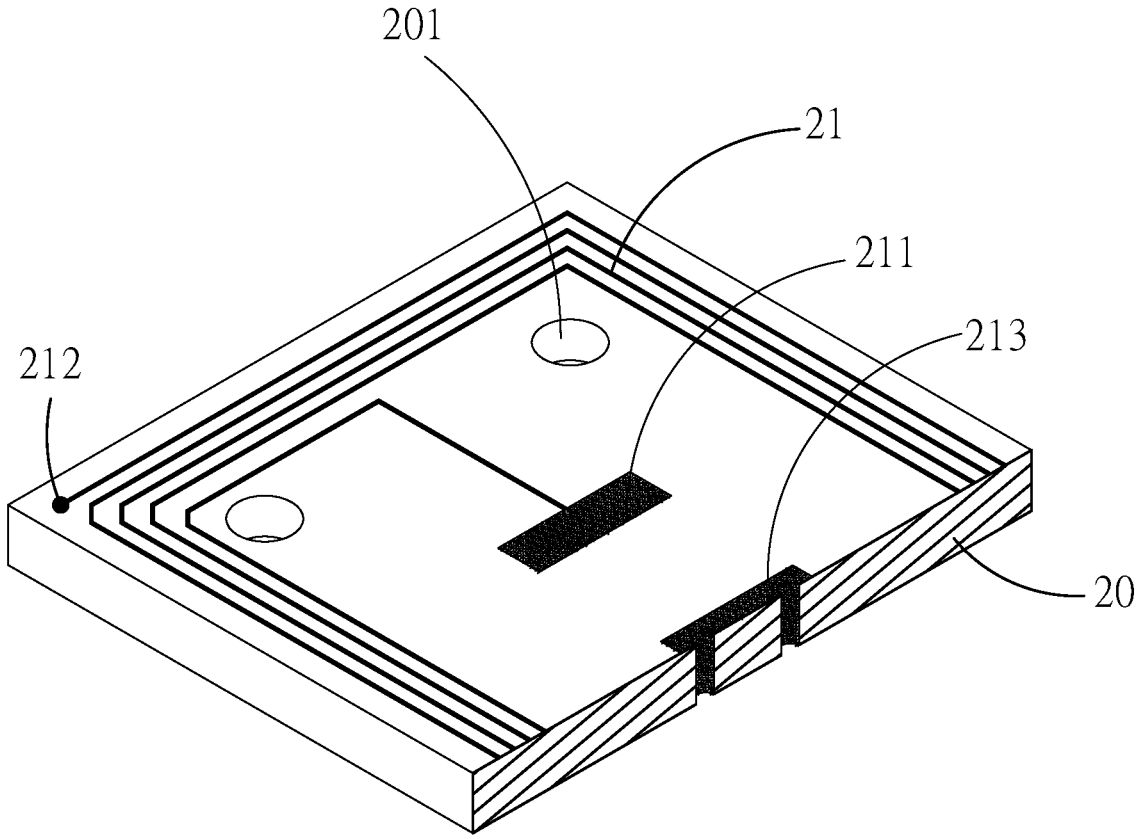
FIG. 4 is a perspective view, partially broken, showing the inspection antenna of the present invention.

Referring to FIGS. 1-3, in this invention, the inspection chip 22 and the main chip 311 may be integrated or encapsulated, in advance, as a system on a chip (SoC), so that the SoC can be mounted on the circuit board 30, and the circuit board 30 is provided with a main circuit 31 and a inspection circuit 32 matching the SoC.

Based on the above, the present invention provides the following advantages:

(1) During a process that the insertion pin A according to the present invention is being locked into a lock base B, the main chip 311 of the circuit board 30 is electrically connected to the main antenna 50 first to emit the first signal, and then, the inspection chip 22 and the inspection antenna 20 are activated or allowed to emit the second signal, so that the second signal may allow an actual operation of quality control to be carried with software loaded in a mobile phone to determine if the first signal is in normal operation, whereby an end user may identify a flaw product.

(2) The present invention is structured to have the inspection antenna 21 mounted on the top surface of the pin member 10 and the main circuit 31 and the inspection circuit 32 are electrically isolated from each other, in combination with the bottom contact 312 being arranged at the bottom of the circuit board 30 and the top contact 322 being arranged at the top of the circuit board 30, so that the main antenna 50 and the inspection antenna 20 are kept spaced from each other by a maximum feasible distance to thereby minimize mutual interference between the second signal and the first signal.

I claim:

1. An electronic seal, which is adapted to use with a mobile phone for quality control, the electronic seal comprising:

an insertion pin, which comprises a pin member in which a circuit board is mounted, the pin member also includes an inspection antenna and an inspection chip mounted therein, the circuit board being provided with a main circuit, a main chip, and an inspection circuit that is set in an open-circuit condition with respect to the inspection antenna and the inspection chip; and a lock base, which is provided with a main antenna cooperating with the main chip so that an operation of inserting and fixing the pin member in the lock base causes the main chip and the main antenna to electrically connect to emit a first signal for monitoring and to further control the inspection circuit to electrically connect with the inspection chip and the inspection antenna to issue a second signal, wherein the second signal enables quality control to be implemented with software of the mobile phone to determine if the first signal is in normal operation, and wherein cutting off the insertion pin terminates the first signal and the second signal, the first signal and the second signal being arranged with different frequency bands.

2. The electronic seal according to claim 1, wherein the electrical connection of the main chip and the main antenna causes emission of the first signal in an RFID frequency band or a microwave frequency band and the electrical connection of the inspection chip, the inspection antenna, and the inspection circuit causes emission of the second signal in a magnetic field frequency band, the magnetic field frequency band being of an NFC system or an LF system.

3. The electronic seal according to claim 2, wherein during the operation of inserting and fixing and the pin member in the lock base, the electrical connection between the main chip and the main antenna is made first to emit the first signal, and then, the inspection circuit, the inspection chip, and the inspection antenna are allowed to emit the second signal.

4. The electronic seal according to claim 1, wherein the inspection chip and the main chip are integrated as a system on a chip (SoC) and the SoC is mounted on the circuit board, and the circuit board is provided with the main circuit and the inspection circuit that cooperates with the SoC.

5. The electronic seal according to claim 2, wherein the inspection chip and the main chip are integrated as a system on a chip (SoC) and the SoC is mounted on the circuit board, and the circuit board is provided with the main circuit and the inspection circuit that cooperates with the SoC.

6. The electronic seal according to claim 3, wherein the inspection chip and the main chip are integrated as a system on a chip (SoC) and the SoC is mounted on the circuit board, and the circuit board is provided with the main circuit and the inspection circuit that cooperates with the SoC.

7. The electronic seal according to claim 1, wherein the first signal and the second signal are built therein with an identical serial number.

8. The electronic seal according to claim 2, wherein the first signal and the second signal are built therein with an identical serial number.

9. The electronic seal according to claim 1, wherein the main circuit and the inspection circuit of the circuit board are electrically isolated from each other; the inspection antenna is mounted on a top surface of the pin member; and the main circuit comprises a bottom contact arranged at a bottom of the circuit board and cooperating with the main antenna, so as to control the main antenna and to keep a maximum distance between the main antenna and the inspection antenna.

10. The electronic seal according to claim 9, wherein the inspection antenna and the inspection chip are mounted on the top surface of the pin member via an insulation substrate, such that the inspection antenna, the inspection chip, and the pin member jointly form a conductive path, the inspection circuit comprising an elastic contact leg set in abutting engagement with the pin member, a top contact being arranged under the substrate to be set in the open-circuit condition with respect to the inspection antenna, such that the operation of inserting and fixing the pin member in the lock base allows the inspection antenna and the top contact to be in conductive contact with each other to emit the second signal.

11. The electronic seal according to claim 10, wherein the pin member is formed with an accommodation hole extending through the top surface and a bottom surface thereof, the circuit board being mounted in the accommodation hole, the substrate closing the accommodation hole, the inspection antenna being in a helical form arranged on a top of the substrate and having an internal starting terminal and an external ending terminal and being further provided with a separate terminal that is spaced from the internal starting terminal by a predetermined distance, the substrate being provided, on a bottom thereof, with a planar terminal that is connected with the separate terminal and an annular terminal that is arranged around a center defined by the planar terminal and connected with the external ending terminal, the planar terminal being arranged in the accommodation hole, the annular terminal corresponding to and in abutting engagement with an annular top surface of the pin member, the inspection chip being mounted between the internal starting terminal and the separate terminal.

12. The electronic seal according to claim 11, wherein the pin member has a top having an outer circumference that is covered with a plastic cover, the plastic cover being provided with multiple positioning pins, the substrate being formed with positioning holes corresponding to and engageable with the positioning pins, the substrate having an outer periphery that is attached with an enclosure film that is combinable with the plastic cover.

13. The electronic seal according to claim 2, wherein the main circuit and the inspection circuit of the circuit board are electrically isolated from each other; the inspection antenna is mounted on a top surface of the pin member; and the main circuit comprises a bottom contact arranged at a bottom of the circuit board and cooperating with the main antenna, so as to control the main antenna and to keep a maximum distance between the main antenna and the inspection antenna.

14. The electronic seal according to claim 13, wherein the inspection antenna and the inspection chip are mounted on the top surface of the pin member via an insulation substrate, such that the inspection antenna, the inspection chip, and the pin member jointly form a conductive path, the inspection circuit comprising an elastic contact leg set in abutting engagement with the pin member, a top contact being arranged under the substrate to be set in the open-circuit condition with respect to the inspection antenna, such that the operation of inserting and fixing the pin member in the lock base allows the inspection antenna and the top contact to be in conductive contact with each other to emit the second signal.

15. The electronic seal according to claim 14, wherein the pin member is formed with an accommodation hole extending through the top surface and a bottom surface thereof, the circuit board being mounted in the accommodation hole, the substrate closing the accommodation hole, the inspection antenna being in a helical form arranged on a top of the substrate and having an internal starting terminal and an external ending terminal and being further provided with a separate terminal that is spaced from the internal starting terminal by a predetermined distance, the substrate being provided, on a bottom thereof, with a planar terminal that is connected with the separate terminal and an annular terminal that is arranged around a center defined by the planar terminal and connected with the external ending terminal, the planar terminal being arranged in the accommodation hole, the annular terminal corresponding to and in abutting engagement with an annular top surface of the pin member, the inspection chip being mounted between the internal starting terminal and the separate terminal.

16. The electronic seal according to claim 15, wherein the pin member has a top having an outer circumference that is covered with a plastic cover, the plastic cover being provided with multiple positioning pins, the substrate being formed with positioning holes corresponding to and engageable with the positioning pins, the substrate having an outer periphery that is attached with an enclosure film that is combinable with the plastic cover.

17. The electronic seal according to claim 3, wherein the main circuit and the inspection circuit of the circuit board are electrically isolated from each other; the inspection antenna is mounted on a top surface of the pin member; and the main circuit comprises a bottom contact arranged at a bottom of the circuit board and cooperating with the main antenna, so as to control the main antenna and to keep a maximum distance between the main antenna and the inspection antenna.

18. The electronic seal according to claim 17, wherein the inspection antenna and the inspection chip are mounted on the top of the pin member via an insulation substrate, such that the inspection antenna, the inspection chip, and the pin member jointly form a conductive path, the inspection circuit comprising an elastic contact leg set in abutting engagement with the pin member, a top contact being arranged under the substrate to be set in the open-circuit condition with respect to the inspection antenna, such that the operation of inserting and fixing the pin member in the lock base allows the inspection antenna and the top contact to be in conductive contact with each other to emit the second signal.

19. The electronic seal according to claim 18, wherein the pin member is formed with an accommodation hole extending through the top surface and a bottom surface thereof, the circuit board being mounted in the accommodation hole, the substrate closing the accommodation hole, the inspection antenna being in a helical form arranged on a top of the substrate and having an internal starting terminal and an external ending terminal and being further provided with a separate terminal that is spaced from the internal starting terminal by a predetermined distance, the substrate being provided, on a bottom thereof, with a planar terminal that is connected with the separate terminal and an annular terminal that is arranged around a center defined by the planar terminal and connected with the external ending terminal, the planar terminal being arranged in the accommodation hole, the annular terminal corresponding to and in abutting engagement with an annular top surface of the pin member, the inspection chip being mounted between the internal starting terminal and the separate terminal.

20. The electronic seal according to claim 19, wherein the pin member has a top having an outer circumference that is covered with a plastic cover, the plastic cover being provided with multiple positioning pins, the substrate being formed with positioning holes corresponding to and engageable with the positioning pins, the substrate having an outer periphery that is attached with an enclosure film that is combinable with the plastic cover.

* * * * *